US008997929B1

(12) United States Patent
Todd et al.

(10) Patent No.: US 8,997,929 B1
(45) Date of Patent: Apr. 7, 2015

(54) TREE STAND LADDER LOCKING DEVICE

(76) Inventors: David A. Todd, Clarksville, OH (US); John Todd, Clarksville, OH (US)

( * ) Notice: Subject to any disclaimer, the term of this patent is extended or adjusted under 35 U.S.C. 154(b) by 253 days.

(21) Appl. No.: 13/095,959

(22) Filed: Apr. 28, 2011

(51) Int. Cl.
*E06C 7/16* (2006.01)
*E06C 7/18* (2006.01)

(52) U.S. Cl.
CPC ..... *E06C 7/182* (2013.01)

(58) Field of Classification Search
CPC ..... E06C 7/182; E06C 7/185; A47C 16/04
USPC ..... 182/106, 116
See application file for complete search history.

(56) References Cited

U.S. PATENT DOCUMENTS

| | | | | | |
|---|---|---|---|---|---|
| 268,078 | A | * | 11/1882 | Bushnell | 182/94 |
| 279,053 | A | * | 6/1883 | Vaughn | 182/106 |
| 2,368,081 | A | * | 1/1945 | Marsh | 182/106 |
| 2,880,829 | A | * | 4/1959 | Watkins | 52/101 |
| 3,106,986 | A | * | 10/1963 | Ray | 182/106 |
| 3,225,863 | A | | 12/1965 | Ludlow | |
| 3,311,195 | A | | 3/1967 | Singer | |
| 4,126,206 | A | * | 11/1978 | Becnel | 182/129 |
| 4,450,937 | A | * | 5/1984 | Broughton | 182/206 |
| 4,524,848 | A | * | 6/1985 | Russo | 182/77 |
| 4,579,197 | A | * | 4/1986 | Spurling | 182/106 |
| 5,421,428 | A | * | 6/1995 | Ingles | 182/106 |
| 5,441,126 | A | * | 8/1995 | Orrick | 182/106 |
| 5,832,755 | A | | 11/1998 | Crilly | |
| 5,938,397 | A | * | 8/1999 | Schouest | 414/537 |
| 6,389,629 | B1 | * | 5/2002 | Schouest | 14/69.5 |
| 6,520,523 | B2 | * | 2/2003 | Beck | 280/164.1 |
| 6,899,201 | B2 | * | 5/2005 | Thiessen | 182/106 |
| 7,793,759 | B1 | * | 9/2010 | Aiken, Jr. | 182/106 |
| 8,720,644 | B2 | * | 5/2014 | Naranjo et al. | 182/106 |

FOREIGN PATENT DOCUMENTS

| | | | | | |
|---|---|---|---|---|---|
| GB | 2373016 | A | * | 9/2002 | E06C 5/32 |
| GB | 2403257 | A | * | 12/2004 | E06C 7/00 |

* cited by examiner

*Primary Examiner* — Alvin Chin-Shue
*Assistant Examiner* — Candace L Bradford
(74) *Attorney, Agent, or Firm* — Robert C. Montgomery; Montgomery Patent & Design

(57) ABSTRACT

A ladder locking designed intended to prevent access to a tree stand and an attached ladder includes a two-piece interlocking frame, top and bottom hooks to engage rungs of the ladder, and a locking bar. The frames include a mesh covers having a width greater than the tree stand ladder. The frame is secured to the ladder by the top and bottom hooks, which provide opposing hangers hooked over and clamping ladder rungs. A bottom of the frame includes a locking bar which insertingly engages between the two frame sections and secured with a padlock. The frame is placed over a ladder and locked to prevent unwanted persons from ascending the ladder.

12 Claims, 6 Drawing Sheets

TREE STAND LADDER LOCKING DEVICE

RELATED APPLICATIONS

The present invention was first described in a notarized Official Record of Invention on Dec. 15, 2009, that is on file at the offices of Montgomery Patent and Design, LLC, the entire disclosures of which are incorporated herein by reference.

FIELD OF THE INVENTION

The present invention relates generally to tree stands and ladder guards, and in particular, to tree stand ladder locking device for the purpose of restricting access to a tree stand by preventing use of the ladder.

BACKGROUND OF THE INVENTION

Over the years, modern advances in hunting equipment have enhanced the sport, providing hunters with increased success. Although many of these products are high-technology devices, some products are amazingly simple. An example of such a product is a tree stand which allows the hunter to hunt from an elevated location while being visually hidden in the confines of a tree. These tree stands typical utilize a ladder to access the elevated platform and are often left in place from day to day, or even hunting season to hunting season. However, this practice unfortunately leaves them open to unauthorized use by other hunters as well as access to children to may attempt to climb as well. This obviously poses both a security and safety risk for the tree stand owner.

Various attempts have been made to provide ladder guards. While these attempts may achieve their purported objective each suffers from one (1) or more disadvantage or deficiency related to design or utilization. Particularly, these attempts include guards which must be permanently attached to the ladder, are designed for particular ladder designs and not adaptable to different styles of ladders, have large hinged sections which are not easily transportable, or have elaborate construction with many piece parts which are difficult to install.

SUMMARY OF THE INVENTION

The inventor has therefore recognized the aforementioned inherent problems and lack in the art and observed that there is a need for a device in which a tree stand and its ladder access can be secured to prevent unauthorized access. In accordance with the invention, it is an object of the present disclosure to solve these problems.

The inventor recognized these problems and has addressed this need by developing a ladder lock that provides hunters who hunt from tree stands an effective means of securing their tree stand and preventing access by others. The inventor has thus realized the advantages and benefits of providing a cover assembly to block a forward facing surface of a ladder and a locking panel assembly which is adjustably coupled to a bottom end of the cover assembly. The cover assembly includes top hooks affixed to a top edge to engage an upper ladder rung. The locking panel assembly includes bottom hooks affixed to a bottom edge to engage a lower ladder rung. A plurality of position alignable apertures is provided in the assemblies for adjusting a position of the locking panel relative to the cover assembly. A locking bar is insertingly fastened between the cover assembly and the locking panel assembly for locking the device at a prescribed length.

The cover assembly includes a cover assembly outer frame and a first mesh section affixed around a perimeter of the cover assembly outer frame. The lower locking panel assembly includes a locking panel outer frame and a second mesh section affixed only to a lower end of the locking panel outer frame. The second mesh section has an unconnected top and sides which allows it to deflect as the locking panel assembly is connected to the cover assembly.

The plurality of position alignable apertures include at least one first locking bar aperture completely through opposing sides of each cover side frame member parallel to the front facing surface and a plurality of second locking bar apertures completely through opposing sides of each locking panel side frame member parallel to the front facing surface. Prescribed and selected pairs of the plurality of second locking bar apertures align with the first locking bar apertures for adjusting the position of the locking panel relative to the cover assembly. The locking bar insertingly engages the aligned pairs of the plurality of second locking bar apertures and the first locking bar apertures.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
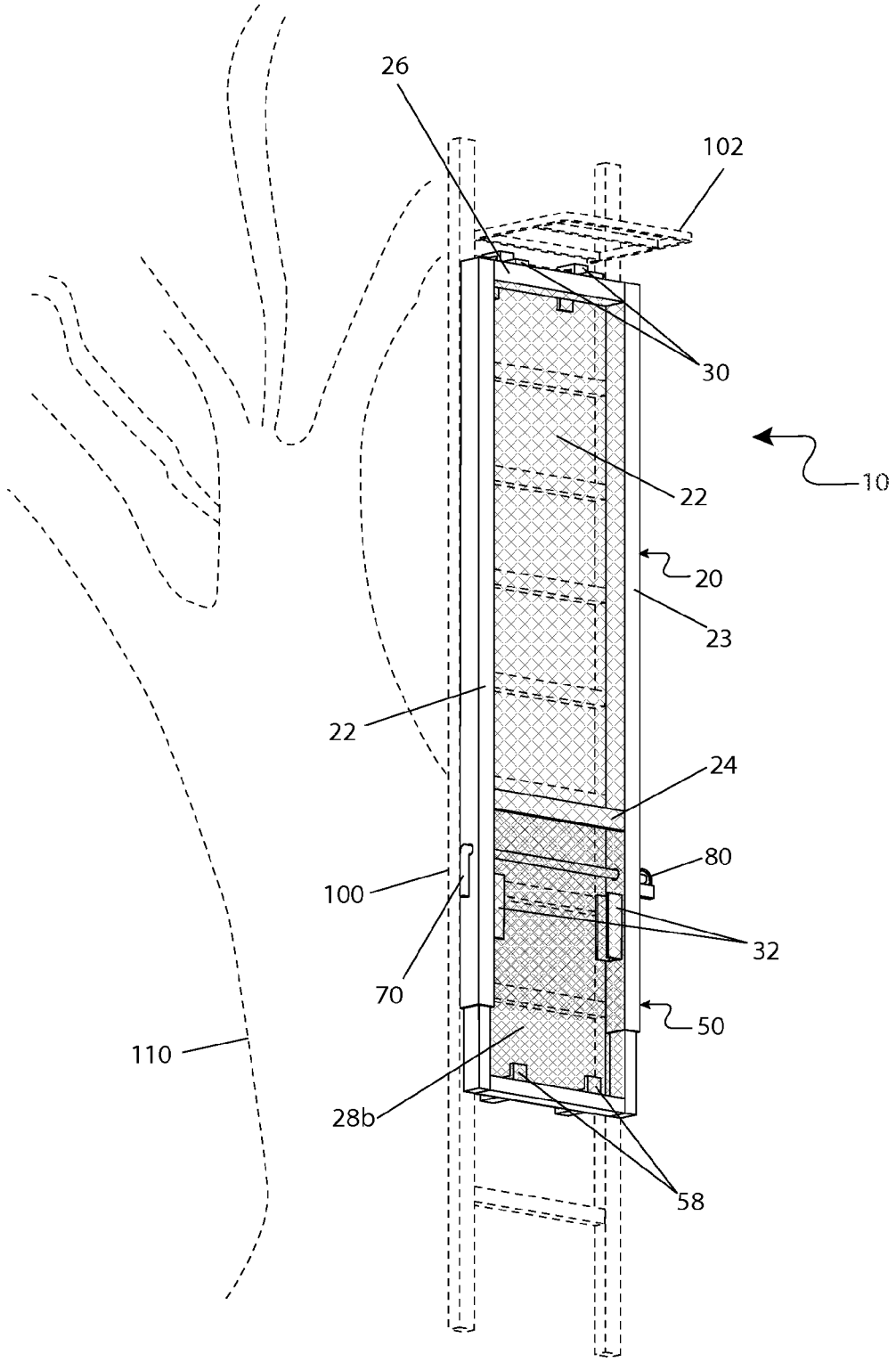
FIG. 1 is an environmental view of a tree stand ladder locking device, according to a preferred embodiment in accordance with the invention.

10 tree stand ladder locking device
20 cover assembly
22 cover side frame member
24 cover cross frame member
26 cover upper frame member
28*a* first metal mesh section
28*b* second metal mesh section
30 first rung hook

32 guide
34 first locking bar aperture
50 locking panel assembly
52 locking panel side frame member
54 locking panel lower frame member
58 second rung hook
59 extension member
60 second locking bar aperture
70 locking bar
71 padlock aperture
80 padlock
100 tree stand ladder
102 tree stand
105 ladder rung
110 tree
120 weld

DETAILED DESCRIPTION OF THE PREFERRED EMBODIMENT

In accordance with the invention, the best mode is presented in terms of a preferred embodiment, herein depicted within FIGS. 1 through 4*b*. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 4*b*, depicting a tree stand ladder locking device (herein described as a "device") 10, where like reference numerals represent similar or like parts. In accordance with the invention, the present disclosure describes a ladder lock which restricts access to a ladder portion 100 of a tree stand 102. The device 10 includes an upper cover assembly 20 and a lower locking panel assembly 50, each including respective tubular metal frames covered with sturdy metal mesh sections. The panels further include respective top hooks 30 and bottom hooks 58 to secure the device 10 to tree stand ladder rungs 105. The device 10 is secured to the ladder rungs 105 by inserting a locking bar 70 and applying a lock 80. In use, a user hangs the device 10 over the tree stand ladder rungs 105 and utilizes the locking bar 70 to secure it in place, thereby preventing unauthorized persons from ascending the ladder 100.

FIG. 1 shows an environmental view of the device 10. The upper cover assembly 20 and the lower locking panel assembly 50 each have tubular frames and are covered with a first metal mesh section 28*a* which is affixed to the frame, preferably by welding. The upper cover assembly 20 includes a pair of cover side frame members 22 and the lower locking panel assembly 50 includes a pair of locking panel side frame members 52, the side frame members 22, 52 extend along vertical outer edges and are constructed of differently sized rectangular tubing, so as to allow insertion and telescoping engagement with each other to provide an adjustable combined length for the device 10. The device 10 is preferably introduced having a variety of available overall lengths based upon particular tree stand 102 designs and a user's preference.

The cover assembly 20 further includes a pair of downward-facing first rung hooks 30 which are ruggedly affixed to the frame of the cover assembly 20 along a top edge. The first rung hooks 30 are downwardly bent to engage and captivate a prescribed tree stand ladder rung 105, preferably located near a top of the tree stand ladder 100. In a similar manner, the locking panel assembly 50 includes an affixed pair of upwardly-facing second rung hooks 58 welded to a bottom horizontal edge. The second rung hooks 58 are upwardly bent to engage and captivate a respectively positioned tree stand ladder rung 105, preferably located at a bottom of the tree stand ladder 100 near a ground surface. In this manner, the device 10 is joined and secured to cover a front facing surface of the tree stand ladder 100.

Figure 2:
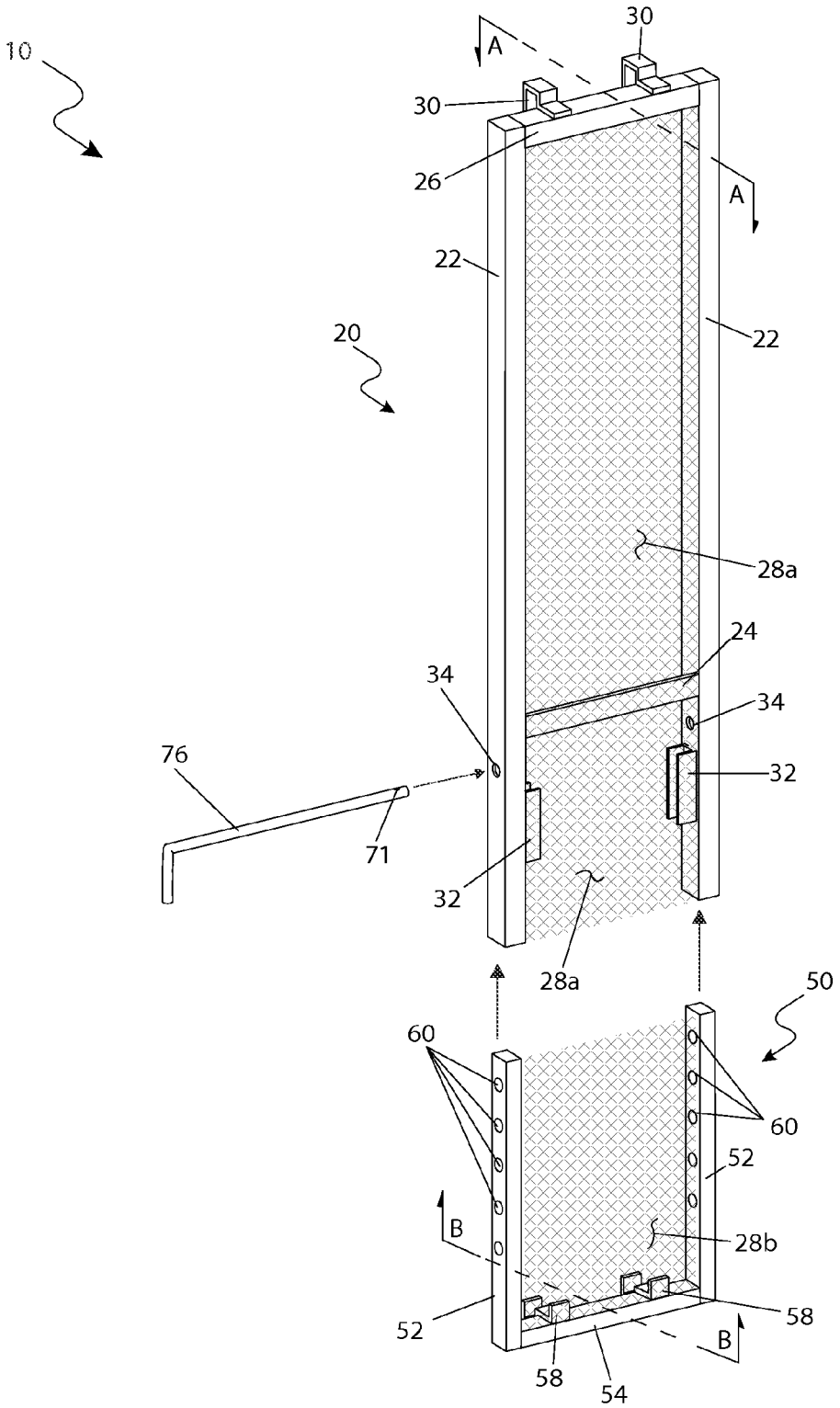
FIG. 2 is a front exploded view of the tree stand ladder locking device, according to the preferred embodiment.

FIG. 2 shows a front exploded view of the device 10. The upper cover assembly 20 and lower locking panel assembly 50 are secured together by the horizontal locking bar 70 (see FIG. 2). The upper cover assembly 20 includes the one-piece, rectangular welded frame having the pair of parallel cover frame side members 22, a cover cross frame member 24, a cover upper frame member 26, and the first metal mesh section 28*a* welded to a front surface of the frame members 22, 24, 26. The locking panel assembly 50 includes the one-piece, "U"-shaped welded frame having the pair of parallel locking panel side frame members 52 joined along a bottom edge by a locking panel lower frame member 54. The locking panel assembly 50 is covered along a front surface with a welded second metal mesh section 28*b*.

Each cover side frame member 22 includes an opposing first locking bar apertures 34 which aligns with corresponding pairs of second locking bar apertures 60 formed or machined into the locking panel side frame members 52. Upon insertion of the locking panel side frame members 52 into respective cover side frame members 22 and subsequent engagement of the hooks 30, 58 onto the tree stand ladder rungs 105, the locking bar 70 is inserted coincidentally through the first locking bar apertures 34 and an aligned pair of second locking bar apertures 60 to secure the upper cover assembly 20 to the lower locking panel assembly 50. The locking bar 70 is an "L"-shaped solid steel rod approximately one-half (½) to one (1) inch in diameter further including a lock aperture 71 drilled or formed through a straight end of the locking bar 70. The lock aperture 71 receives a pad lock 80 to secure the device 10 to the tree stand 102 once the locking bar 70 has been completely inserted through both cover side frame members 22 and locking panel side frame members 52.

The cover frame members 22, 24, 26, locking panel frame members 52, 54, and the metal mesh sections 28*a*, 28*b* are preferably made of durable metal materials such as aluminum, carbon steel, stainless steel, or the like. Furthermore, the metal mesh sections 28*a*, 28*b* are preferably commercially available open pattern sheet stock having a plurality of openings made using common processes such as punching, welding, machining, or the like. The expanded metal lattice sheeting which form the mesh sections 28*a*, 28*b* is intended to both reduce wind resistance upon the flat surface of the device 10 and minimize the overall weight of the device 10.

Figure 3A:
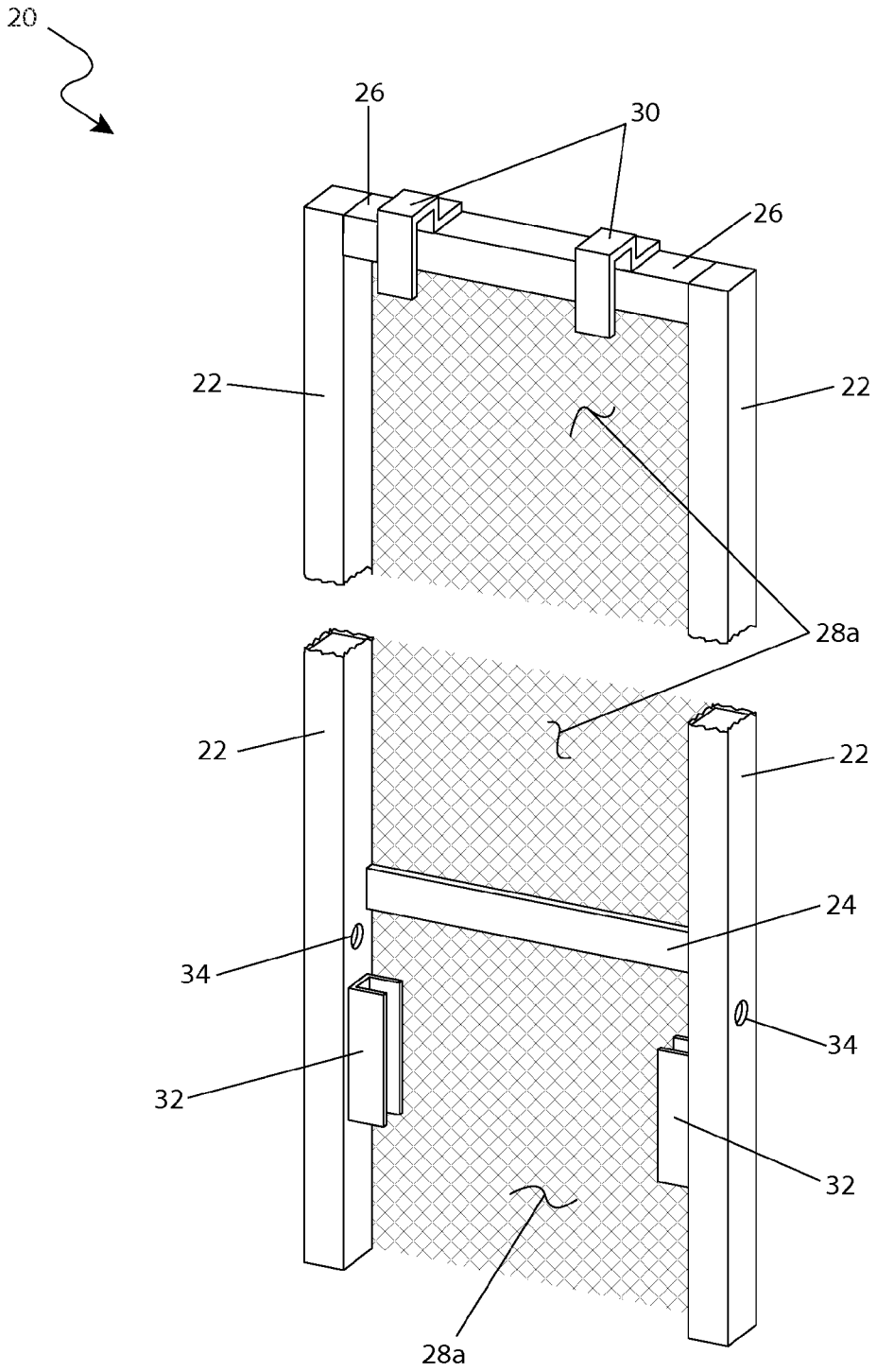
FIG. 3*a* is a close-up view of a rear side of a cover assembly of the tree stand ladder locking device, according to the preferred embodiment.
Figure 3B:
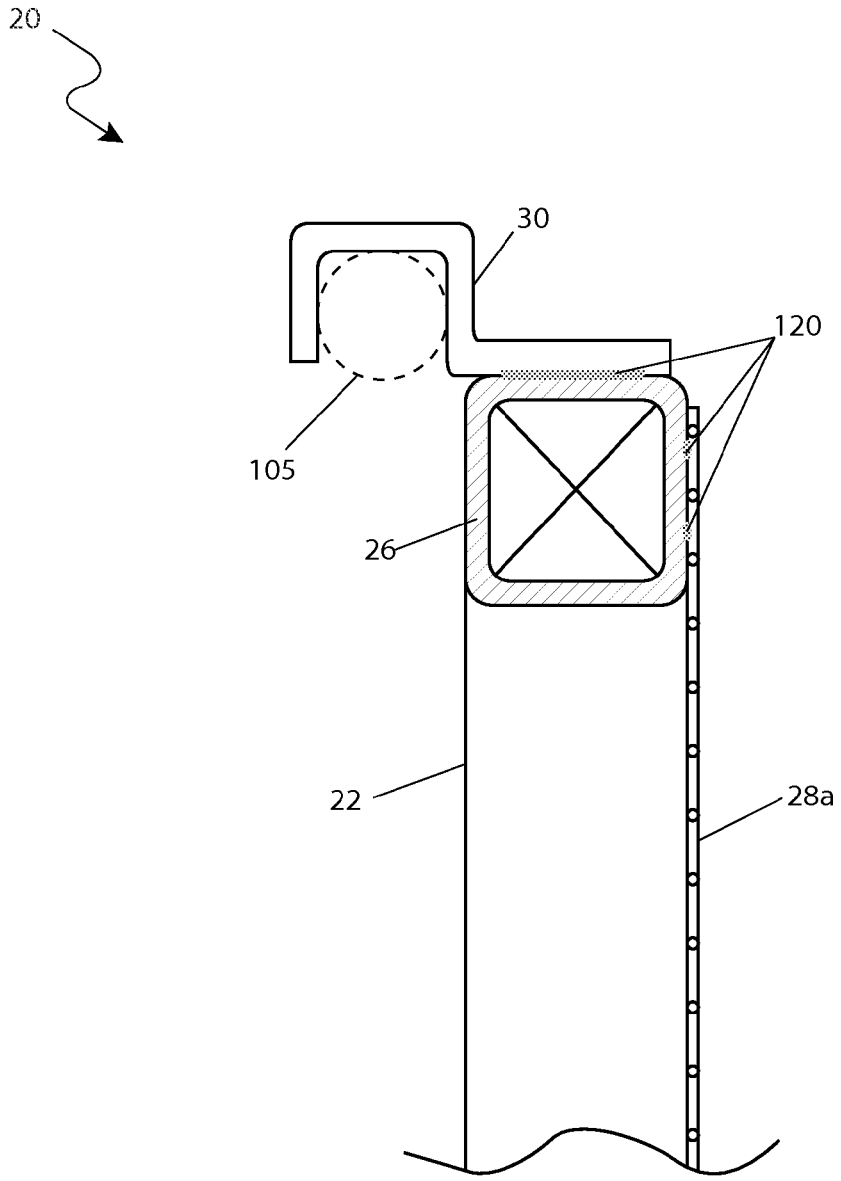
FIG. 3*b* is a section view of a cover assembly of the tree stand ladder locking device taken along section line A-A of FIG. 2, according to the preferred embodiment.

FIGS. 3*a* and 3*b* show a rear close-up and a section view of the cover assembly 20. The pair of first rung hooks 30 are formed steel bars approximately two (2) inches in width and one-half (½) inch thick and are securely welded to a top surface of the cover upper frame member 26 and extend inwardly toward the tree stand ladder rungs 105. The first rung hooks 30 form an inverted "U"-shape so as to captivate the tree stand ladder rung 105 therewithin. The cover side frame members 22 further include a pair of welded "U"-shaped guides 32 which are welded to opposing inward facing surfaces to provide a guiding channel to receive the second metal mesh section 28*b* when the locking panel side frame members 52 are inserted within the cover side frame members 22. The guides 32 prevent the wire mesh sections 28*a*, 28*b* from sliding over each other or otherwise interfering during insertion and length adjustment of the device 10 (see FIGS. 1 and 2).

Figure 4A:
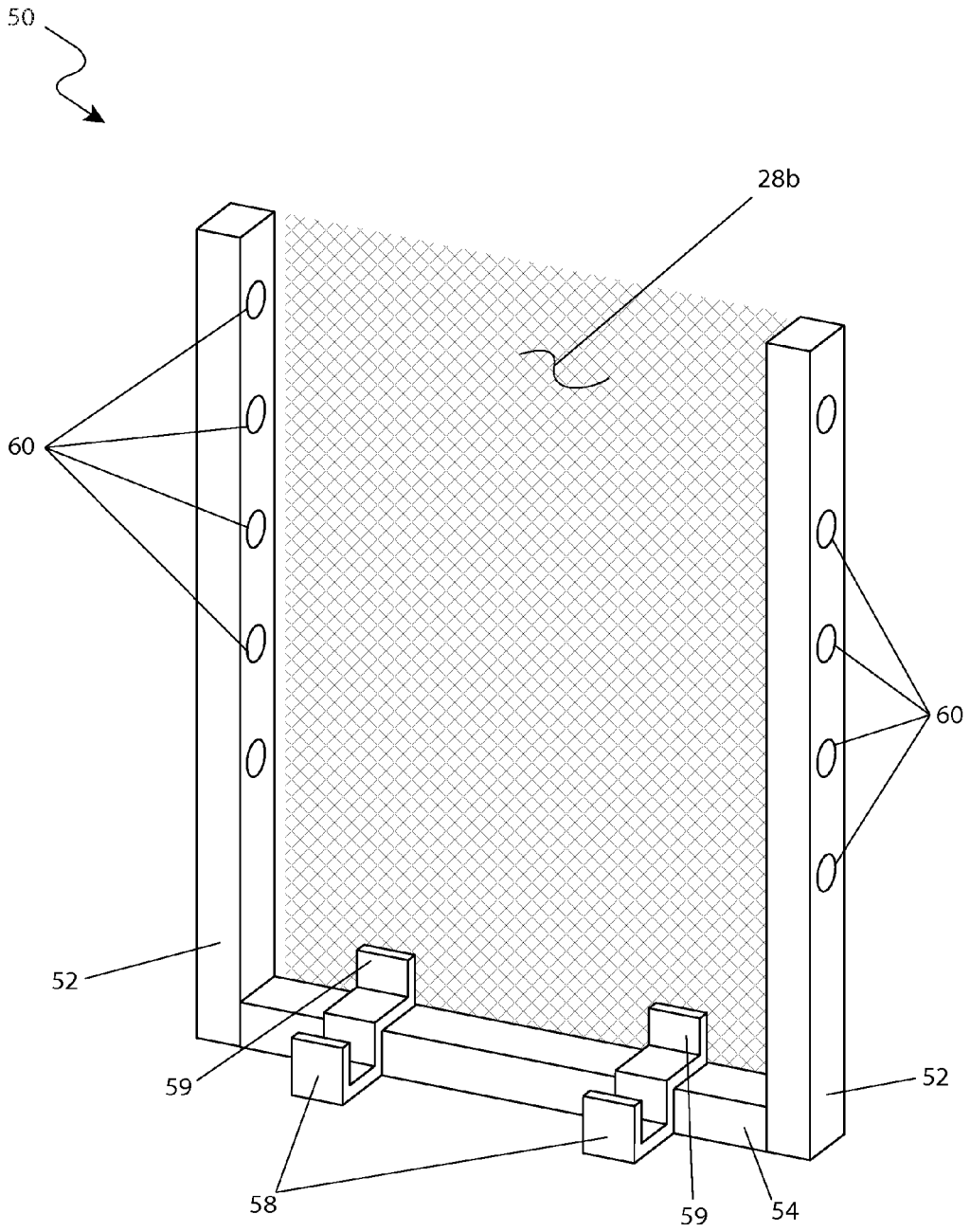
FIG. 4*a* is a close-up view of a rear side of a lock assembly of the tree stand ladder locking device, according to the preferred embodiment; and, FIG. 4*b* is a section view of the lock assembly of the tree stand ladder locking device taken along section line B-B of FIG. 2, according to a preferred embodiment.
Figure 4B:
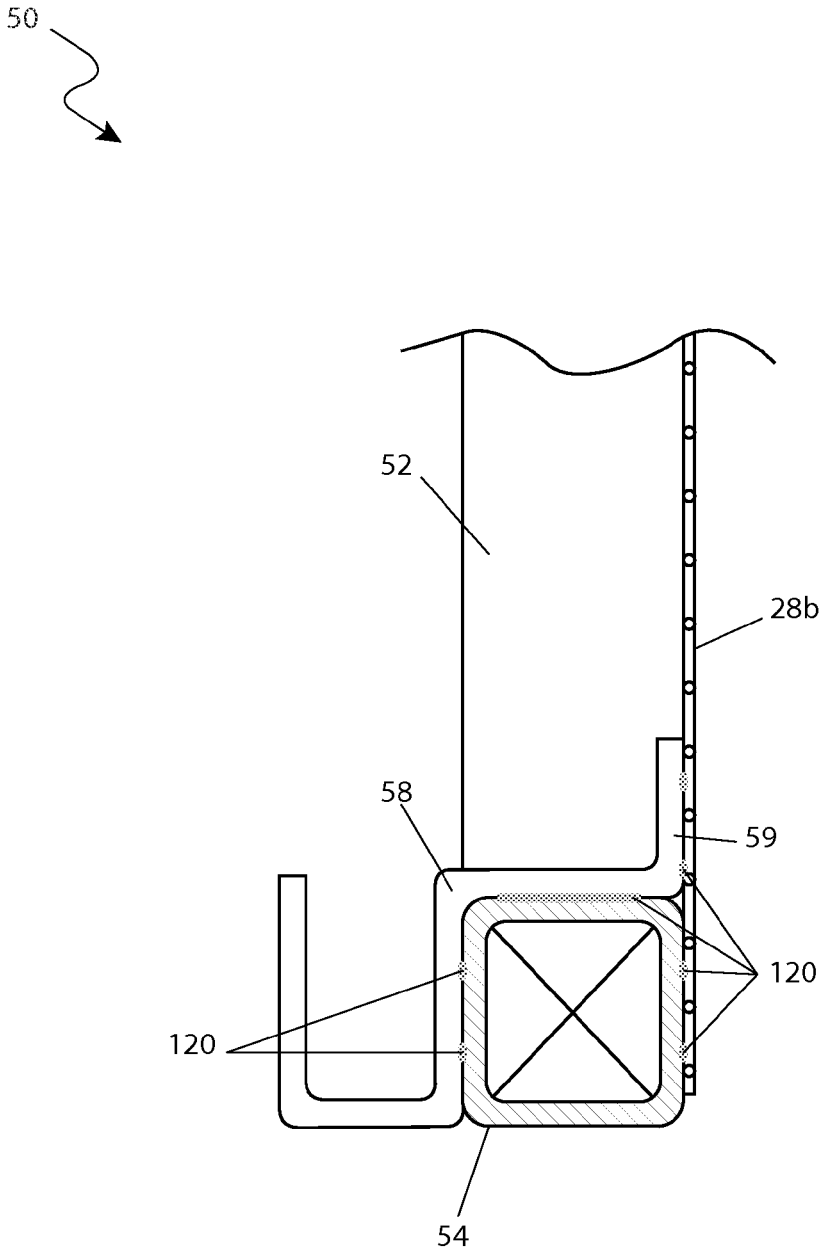

FIGS. 4*a* and 4*b* show a rear close-up and a section view of a lock assembly 50. The second rung hooks 58 provide similar materials and function as the aforementioned first rung hooks 30; however, the second rung hooks 58 are welded to a top surface of the locking panel lower frame member 54 and are upwardly bent to form the "U"-shape. The second rung hooks 58 include an additional formed extension member 59 which extends upwardly from the locking panel lower frame member 54. The extension member 59 provides added surface area onto which the vertical section of the second metal mesh section 28*b* is welded. The second metal mesh section 28*b* is affixed to front-facing surfaces of the locking panel lower frame member 54 and the extension members 59. The second metal mesh section 28*b* extends upwardly between the opposing locking panel side frame members 52. A small gap is defined between the second metal mesh section 28*b* and the locking panel side frame members 52 of approximately one (1) inch to provide clearance for the cover side frame members 22 to receive the locking panel side frame members 52 during assembly of the device 10. In the preferred embodiment, the second metal mesh section 28*b* is affixed to the locking panel lower frame member 54 and the extension members 59 by a plurality of welds 120.

It is envisioned that other styles and configurations can be easily incorporated into the teachings of the present disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the device 10, it would be installed as indicated in FIG. 1.

The method of installing and utilizing the device 10 may be achieved by performing the following steps: procuring a model of the device 10 having a desired overall length; transporting the device 10 to an existing tree stand 102; separating the cover assembly 20 from the locking panel assembly 50 by removing the padlock 80 and locking bar 70; lifting the cover assembly 20 upwardly against a ladder 100 of the tree stand 102 until the first rung hooks 30 engage a desired tree stand ladder rung 105; inserting the locking panel side frame members 52 into respective cover side frame members 22 until the second rung hooks 58 engage a desired tree stand ladder rung 105; aligning the first locking bar apertures 34 with a desired aligned pair of second locking bar apertures 60; inserting the locking bar 70 through the aligned apertures 34, 60; installing a padlock 80 into the padlock aperture 71 of the locking bar 70; and, benefiting from securing a tree stand 102 against use by unauthorized persons by utilizing the present invention 10.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A tree stand ladder locking device comprising:

a cover assembly configured to block at least a portion of a forward facing surface of a ladder, said cover assembly comprising a top end and a longitudinally opposed bottom end, said cover assembly comprising a cover assembly outer frame having a top frame member and a parallel pair of side frame members and a first mesh section affixed to said cover assembly outer frame and extending from said top end to said bottom end of said cover assembly;

a locking panel assembly comprising a top end and a longitudinally opposed bottom end, said locking panel assembly comprising a locking panel assembly outer frame having a bottom frame member and a parallel pair of side frame members and a second mesh section affixed to said locking panel assembly outer frame and extending from said bottom end toward said top end of said locking panel assembly, said locking panel assembly top end being received by said cover assembly bottom end such that said pair of side frame members of said locking panel assembly outer frame are positioned between said pair of side frame members of said cover assembly outer frame to adjustably couple said locking panel assembly to said cover assembly;

at least one top hook affixed to a top edge of said cover assembly to engage a generally upper ladder rung;

at least one bottom hook affixed to a bottom edge of said locking panel assembly to engage a lower ladder rung; and, a locking bar insertingly fastened between said cover assembly and said locking panel assembly for locking said device at a prescribed length.

2. The device of claim 1, wherein:

said cover assembly comprises a pair of opposed first locking bar apertures disposed through said pair of side frame members of said cover assembly outer frame;

said locking panel assembly comprises a plurality of pairs of opposed second locking bar apertures disposed through said pair of side frame members of said locking panel assembly frame;

a selected pair of opposed second locking bar apertures of said plurality of pairs of opposed second locking bar apertures is aligned with said pair of first locking bar apertures to adjust a length of said device at said prescribed length; and said locking bar is received by said selected pair of opposed second locking bar apertures and said pair of first locking bar apertures to lock said device at said prescribed length.

3. The device of claim 1, wherein said cover assembly further comprises a pair of channel guides affixed to said pair of side frame members of said cover assembly outer frame proximate said bottom end of said cover assembly, said channel guides being configured to receive said side frame members of said locking panel outer frame upon coupling of said locking panel assembly to said cover assembly.

4. The device of claim 1, wherein said locking bar further comprises an elongated member configured to extend laterally across said cover assembly outer frame.

5. The device of claim 1, wherein said at least one bottom hook further comprises an extension member extending upwardly from said bottom frame member of said locking panel outer frame; wherein said second mesh section is affixed to said extension member.

6. The device of claim 1, wherein said first mesh section and said second mesh section are each formed of expanded metal lattice sheeting.

7. The device of claim 1, wherein:

said side frame members of said cover assembly outer frame extend from said top end to said bottom end of said cover assembly, said pair side frame members of said cover assembly outer frame being laterally spaced apart;

said top frame member of said cover assembly outer frame is affixed between said pair of side frame members of said cover assembly outer frame proximate said top end of said cover assembly;

said cover assembly comprises a cross frame member affixed between said pair of side frame members of said cover assembly outer frame proximate said bottom end of said cover assembly; and said first mesh panel is affixed to a front facing exterior surface of each of said frame members of said cover assembly.

8. The device of claim 7, wherein:

side frame members of said locking panel assembly outer frame extend from said top end to said bottom end of said locking panel assembly, said pair of side frame members of said locking panel assembly outer frame being laterally spaced apart and positioned between said pair of side frame members of said cover assembly outer frame; and, said bottom frame member of said locking panel assembly outer frame is affixed between said pair of side frame members of said locking panel assembly outer frame proximate said bottom end of said locking panel assembly;

said second mesh section is affixed to a front facing exterior surface of said bottom frame member of said locking panel assembly outer frame such that a gap is disposed between said second mesh section and said pair of side frame members of said locking panel assembly outer frame.

9. The device of claim 8, wherein said at least one bottom hook further comprises an extension member extending upwardly from said bottom frame member of said locking panel assembly outer frame; wherein said second mesh section is affixed to a front facing exterior surface of said extension member.

10. The device of claim 9, wherein each side frame member of said cover assembly outer frame comprises a generally U shaped guide affixed to opposing surfaces of said cover side frame members and proximate said bottom end of said cover assembly, each of said U shaped guides being configured to receive side frame member of said locking panel assembly outer frame upon coupling of said locking panel assembly to said cover assembly.

11. The device of claim 1, wherein said at least one top hook extends outward and downward to engage over top of said upper ladder rung and said at least one bottom hook extends outward and upward to engage over bottom of said lower ladder rung.

12. The device of claim 3, wherein said locking bar further comprises:

a generally L shaped member having an elongated section and an perpendicularly affixed short section; and, a lock aperture disposed completely through an end of said elongated section opposite said short section;

wherein said elongated section insertingly engages aligned pairs of said second locking bar apertures and said first locking bar apertures; and, wherein said lock aperture receives a portable lock for locking said locking bar within said aligned pairs of said plurality of second locking bar apertures and said first locking bar apertures.

* * * * *